United States Patent [19]

VanCucha

[11] Patent Number: 4,881,658

[45] Date of Patent: Nov. 21, 1989

[54] SEALED CONTAINER

[75] Inventor: James M. VanCucha, Strongsville, Ohio

[73] Assignee: Cleveland Container Corporation, Cleveland, Ohio

[21] Appl. No.: 233,071

[22] Filed: Aug. 17, 1988

[51] Int. Cl.[4] ..... B65D 43/06; B65D 43/10

[52] U.S. Cl. ..... 220/306; 220/308; 220/357

[58] Field of Search ..... 220/306, 308, 355, 356, 220/357

[56] References Cited

U.S. PATENT DOCUMENTS

| | | | |
|---|---|---|---|
| 2,717,619 | 9/1955 | Whitman | 220/306 X |
| 2,984,381 | 5/1961 | Bennett | 220/306 |
| 3,113,693 | 12/1963 | Stull | 220/306 |
| 3,355,061 | 11/1967 | Ritter | 220/306 |
| 3,376,996 | 4/1968 | Bardell | 220/306 X |
| 3,510,023 | 5/1970 | Ullman et al. | 220/308 |
| 3,618,802 | 11/1971 | Yates | 220/308 X |
| 3,730,382 | 5/1973 | Heisler . | |
| 3,811,597 | 5/1974 | Frankenberg et al. | 220/306 X |
| 3,942,679 | 3/1976 | Starr . | |
| 3,977,563 | 8/1976 | Holt . | |
| 3,999,677 | 12/1976 | Oberkircher . | |
| 4,004,710 | 1/1977 | Crisci . | |
| 4,042,143 | 8/1977 | Biggins | 220/306 X |
| 4,177,930 | 12/1979 | Crisci . | |
| 4,209,107 | 6/1980 | Crisci . | |
| 4,245,754 | 1/1981 | Ellis | 220/308 X |
| 4,305,535 | 12/1981 | Brundige et al. . | |
| 4,335,827 | 6/1982 | Knize et al. . | |
| 4,457,447 | 7/1984 | Kirkis . | |
| 4,531,650 | 7/1985 | Friendship | 215/321 X |

*Primary Examiner*—Gerald A. Michalsky

*Attorney, Agent, or Firm*—Calfee, Halter & Griswold

[57] ABSTRACT

A container assembly comprising a container open at one end and closed at the other end by a bottom wall, and a closure or lid for closing the open end of the container. The container includes a lip which allows the lid to be utilized either with or without a gasket or sealing material. The closure is bounded by a rim having a protruding hook for engaging the lip of the container and securing the lid on the container. In a preferred embodiment the lip includes an upper detent or horizontally extending arm for engaging the hook of the closure at a first position relative to the sidewall when sealing material is employed with the closure. The lip also includes a lower detent or downwardly extending arm spaced beneath the upper detent for engaging the closure at a second position relative to the sidewall when sealing material is not employed with the closure.

5 Claims, 3 Drawing Sheets

SEALED CONTAINER

This invention relates to a container and lid assembly. More particularly, this invention relates to a container or pail having an open end sealed with a lid and adapted to allow the lid to be used either with or without a gasket or sealing material.

BACKGROUND OF THE INVENTION

The prior art provides various container assemblies having containers with open ends which are closed and sealed with a closure or lid. Some of the prior art containers are used without a gasket or sealing material between the lid and the container. Other prior art container assemblies include sealing material positioned between the top peripheral rim or lip of the container and the lid. Unfortunately, these prior art containers lack some versatility in that they fail to provide a single container assembly that can be used either with or without a gasket or sealing material.

SUMMARY OF THE INVENTION

The present invention provides a container assembly wherein the closure or lid may be intalled on the container either with or without a gasket or sealing material. Thus, the present invention provides a container assembly which eliminates the need and expense associated therewith of producing a separate container assembly for use with sealing material and a separate or second container assembly for use without sealing material.

In a preferred embodiment the lid comprises a circular flat portion or cover bounded by a rim. The rim is designed to securely engage the top of the sidewall of the container and form a seal therewith ensuring retention of the contents in the cavity of the container. A radially outwardly curled sealing lip is formed at the top of the sidewall at its upper most periphery. Along its outer diameter, the lip includes an upper detent or horizontally extending protruding arm and a lower detent or downwardly extending protruding leg spaced just beneath the protruding arm. The upper surface of the protruding arm and lip is flat and it forms a sealing surface for the container.

The rim of the lid includes a radially inner vertical leg and a radially outer vertical leg both of which extend substantially parallel to the sidewall. Interconnecting the inner and the outer leg and extending substantially perpendicular to the sidewall is a bridge. The bridge, inner leg and outer leg cooperatively form a downwardly extending circumferentially continuous channel into which the lip is received. The outer leg includes an inwardly protruding hook which engages the lip of the container securing the lid on the container.

The unique design of the container assembly allows the lid to be installed or placed upon the container either with or without the use of a gasket or sealing material. More particularly, when sealing material is employed, the lid is secured onto the container by the protruding hook which engages the arm of the lip at a first position relative to the sidewall. When sealing material is not employed, the protruding hook engages the downwardly extending protruding leg of the lip, which is positioned just beneath the protruding arm, securing the lid at a second position relative to the sidewall.

In addition to securing a lid without sealing material by engaging the protruding leg of the lip, a container made in accordance with the present invention may be utilized to secure a lid without the use of sealing material by engaging the protruding arm of the lip. When this type of a lid is utilized to close the container, the outer leg of such lid is much shorter than the outer leg of a lid which is designed to engage the protruding leg of the lip without the use of sealing material. Preferably, a lid that is designed to engage the protruding arm without the use of sealing material also includes a hook with a rounded configuration to facilitate the easy removal of the lid from the container.

The foregoing and other features of the invention are hereinafter fully described and particularly pointed out in the claims, the following detailed description and annexed drawings setting forth in detail certain illustrated embodiments of the invention, these being indicative, however, of but a few of the various ways in which the principles of the invention may be employed.

DETAILED DESCRIPTION OF THE PREFERRED EMBODIMENTS

Figure 1:
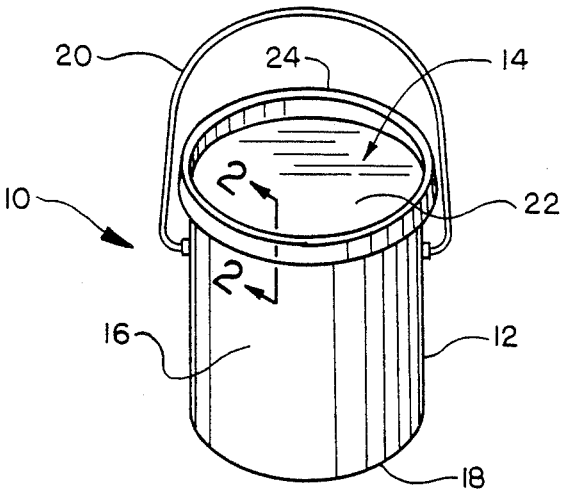
FIG. 1 is a perspective view of a container assembly made in accordance with the present invention with the lid assembled or installed on the container to close its open end.
Figure 2:
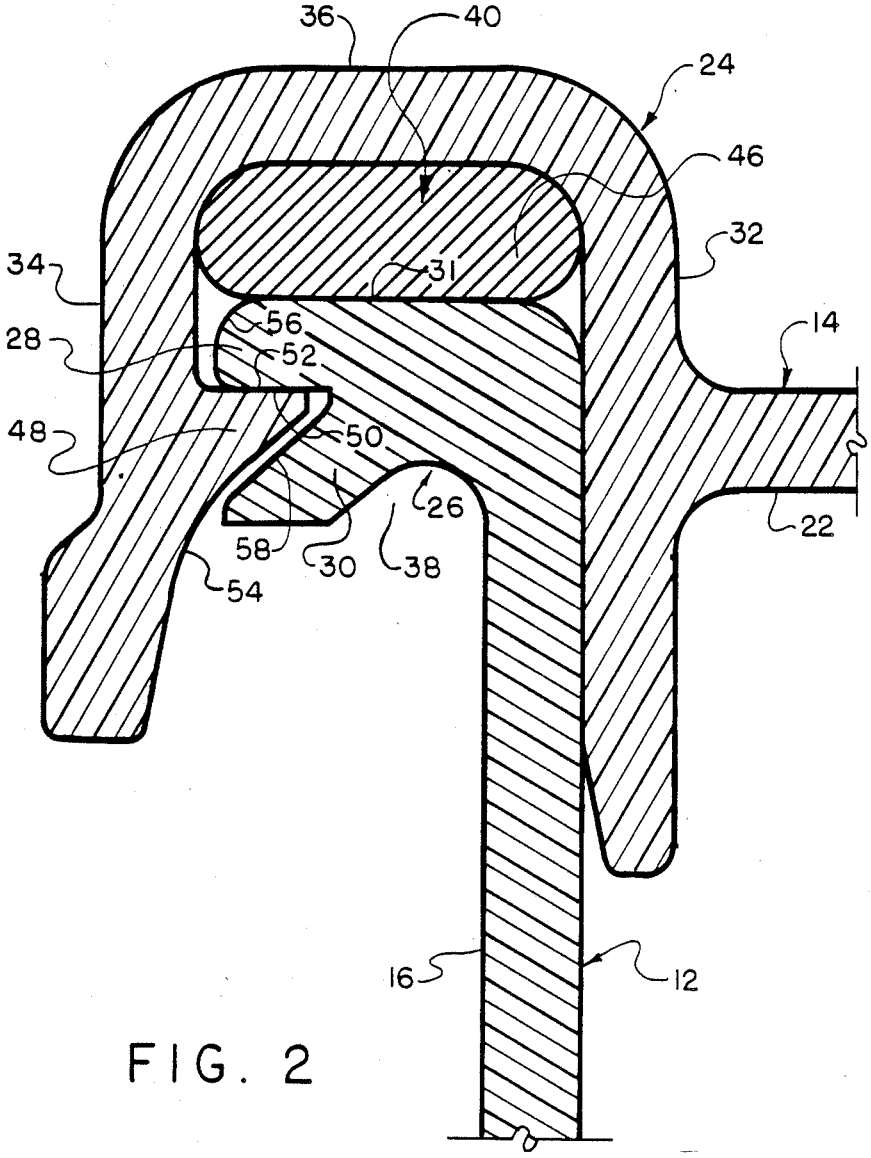
FIG. 2 is a broken away enlarged vertical cross-section of the assembled lid, rim, sealing material and container lip taken along line 2—2 of the container assembly of FIG. 1.

Referring now to the drawings and initially to FIGS. 1 and 2, there is illustrated a container or pail assembly indicated generally at 10. Container assembly 10 comprises a container 12 and a lid or closure 14. The container 12 comprises a generally cylindrical sidewall 16 and a circular base 18 which forms the closed bottom of the container 12. Connected to the sidewall 16 may be a pivotal handle 20 which facilitates the lifting and handling of the container assembly 10 but can selectively be pivoted out of the way to facilitate stacking of the container assembly 10 for storage purposes. The top of the sidewall 16 forms an opening to the container cavity or opening, which is selectively closed or covered by the lid 14.

The lid 14 comprises a circular flat portion or cover 22. Bounding the circumference of the circular cover 22 is a rim 24. The rim 24 is designed to securely engage the top of the sidewall 16 and form a seal therewith ensuring retention of the contents of the cavity of the container 12 and minimizing the ingress of external contaminants.

A radially outwardly curled sealing lip 26 is formed at the top of the sidewall 16 at its upper most periphery. The lip 26 along its inner diameter is contiguous with the sidewall 16. Along its outer diameter the lip 26 includes a horizontally extending protruding arm 28 and a downwardly extending protruding leg 30 which extends at an angle of about 45° relative to the sidewall 16. The upper surface 31 of the lip 26 and the protruding arm 28 is flat and it forms a sealing surface.

The rim 24 of the lid 14 includes a radially inner vertical leg 32 and a radially outer vertical leg 34, both of which extend substantially parallel to the sidewall 16. Interconnecting the inner leg 32 and the outer leg 34 and extending substantially perpendicular to the sidewall 16 is the bridge or top web portion 36. The bridge 36, inner leg 32 and outer leg 34 cooperatively form a downwardly extending circumferentially continuous channel 38 into which the lip 26 is received. The bridge 36, inner leg 32, outer leg 34 also cooperate with the upper surface 31 of the lip 26 to form a seal cavity 40.

As shown in FIG. 2, disposed without the seal cavity 40 is gasket or sealing material 46. Sealing material 46 may comprise any one of a variety of materials. For example, sealing material 46 may comprise a rubber based material mixed with an inert gas that is gunned into the seal cavity 40 and then allowed to set up before the lid 14 is assembled onto the container 12. Of course, it will be appreciated that depending upon the type of gasket or sealing material 46 employed, the configuration of the seal cavity 40 may be modified so as to provide a more effective seal. For example, upper surface 31 may be downwardly or upwardly angled, or provided with sealing projections.

The unique design of the container assembly 10 allows the lid 14 to be installed on the container 12 either with or without the use of a gasket or sealing material 46. More particularly, as shown in FIG. 2 the lid 14 is employed with sealing material 46. The lid 14 is secured onto the container 12 by a protruding hook 48 having a top surface 50 which engages the bottom surface 52 of the protruding arm 28. Hook 48 includes an arcuate camming surface 54 which facilitates the placement of the lid 14 upon the container 12. Specifically, as the lid 14 is being pushed on the container 12, the arcuate camming surface 54 of the hook 48 of the rim 26 slidingly contacts the upper, radially outer corner 56 of the lip 26. As a result of the sliding contact, the outer leg 34 deflects radially outwardly momentarily to expand the channel 38. As the lid is being pushed down the seaing material 46 is compressed between the bridge 36 and the upper surface 31 of the lip 26 forming a seal between the lid 14 and the container 12. When the lid 14 reaches the position shown in FIG. 2 the channel 38 returns to its original shape and the camming surface 54 contacts the top surface 58 of the leg 30. Then, when the lid 14 is no longer being pushed down, the compressed sealing material 46 provides a biasing force which pushes the upper surface 50 of the hook 48 into engagement with the bottom surface 52 of the protruding arm 28 ensuring that the lid 14 is securely maintained on the container 12.

Because it is necessary for the outer leg 34 of the rim 24 to deflect during assembly, preferably the lid 14 is made of a flexible material such as plastic. Container 12 is also preferably made of a flexible material such as plastic. However, it will be appreciated that container 12 may be made out of any one of a variety of materials including, for example, carbon or stainless steel, aluminum or brass.

Figure 3:
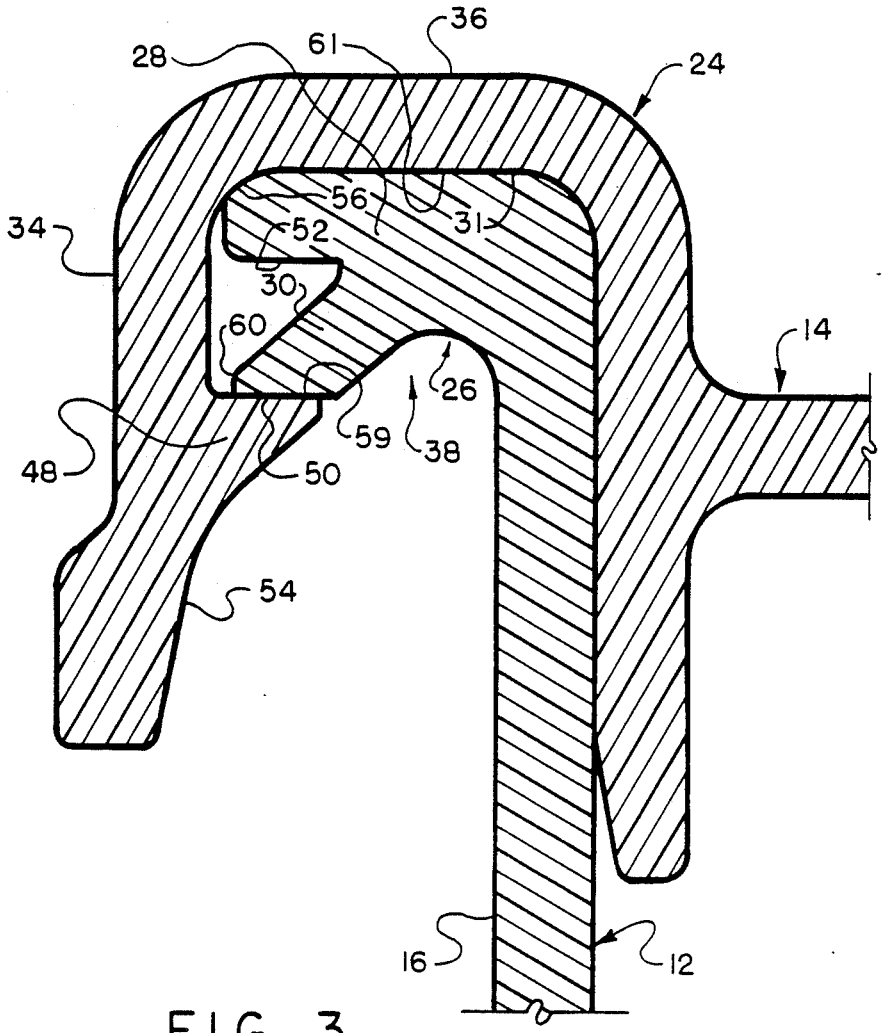
FIG. 3 is a broken away enlarged vertical cross-section of the container assembly of FIG. 1 without the sealing material.

Referring now to FIG. 3, there is illustrated the lid 14 mounted on the container 12 without the use of a gasket or sealing material 46. Specifically, when sealing material 46 is not utilized the top surface 50 of the hook 48 engages the bottom surface 59 of the leg 30. Thus, as the lid 14 is pushed onto the container 14 the camming surface 54 initially contacts the upper corner 56 of the arm 28 momentarily expanding the channel 38. When the hook 48 passes beneath the protruding arm 28 with the top surface 50 immediately beneath the bottom surface 59, the channel 38 returns to its original shape. Then, as the hook 48 continues to pass beneath the protruding arm 28 the camming surface 54 contacts and rides along the radially outer corner 60 of the protruding leg 30 until the upper surface 50 of the hook 48 is aligned with and contacts the bottom surface 59 of leg 30 as shown in FIG. 3. Simultaneously therewith, the top surface 31 of the lip 26 contacts the bridge 36 providing a seal between the lid 14 and the container 12. When the lid 14 is no longer being pushed down, the rim 24 of the lid 14 and the lip 26 of the container 12 afford sufficient resiliency or elasticity that they create a slight biasing force which pushes the upper surface 50 of the hook 48 in contact with the bottom surface 59 ensuring that the lid 14 is securely maintained on the container 12. More particularly, in order to ensure the slight biasing force preferably the distance between the bottom surface 61 of the bridge 36 and the top surface 50 of the hook 48 is slightly smaller than the distance between the top surface 31 of the lip 26 and the bottom surface 59 of the protruding leg 30.

It will be appreciated that, as shown in FIGS. 2 and 3, the relative sizes of the various elements of the lip 26 and rim 24 (e.g., the hook 48, leg 30, arm 28, and seal cavity 40) must be such as to facilitate the proper engagement of the rim 24 with the lip 28 either with or without a gasket or sealing material 46. Although it may not be possible to create a completely airtight seal without the use of a gasket or sealing material 46 in a container assembly made in accordance with the present invention, it will be appreciated that depending upon the type of material utilized to construct the rim 24 and the lip 26, and the precision fit of the various elements which make up the lip 26 and rim 24, it may be possible to create a fairly substantial seal between the lid 14 and container 12. Such a seal may be suitable, for example, for container sand, fine powders, adhesives, spackling compound or high viscosity greases.

It will be further appreciated that although the protruding arm 28 and the protruding leg 30 are shown in the preferred embodiment to be continuous and to extend along the entire circumference of the container 12, a container made in accordance with the present invention may include a segmented or non-continuous protruding arm 28 and/or protruding leg 30. Also, although in the preferred embodiment the protruding arm 28 is located at the very end of the sidewall 16, a container made in accordance with the present invention may include a protruding arm 28 which is spaced down from the top edge of the sidewall 16.

In addition to securing a lid 14 by engaging the protruding leg 30 without the use of a gasket or sealing material 46, container 12 may be utilized to secure a lid 14 without sealing material 46 with the hook of the lid engaging the prtroducing arm 28 of the lip 26. More particularly, referring now to FIG. 3 there is illustrated the container 12 having mounted thereon a lid 66 which engages the bottom surface 52 of the arm 28 and which does not employ a gasket or sealing material 46. Lid 66 is essentially identical to lid 14 illustrated in FIGS. 1-3 except it includes an outer leg 69 which is shorter than the outer leg 34 of lid 14 and it also includes a hook 68 having a rounded end 70. The rounded end 70 of hook 68 facilitates the easy removal of the lid 66 from the container 12 because it serves to contact the radially outer corner 72 of the protruding arm 28 and cam the hook 68 out of engagement with the arm 28 as the lid 66 is removed.

Figure 4:
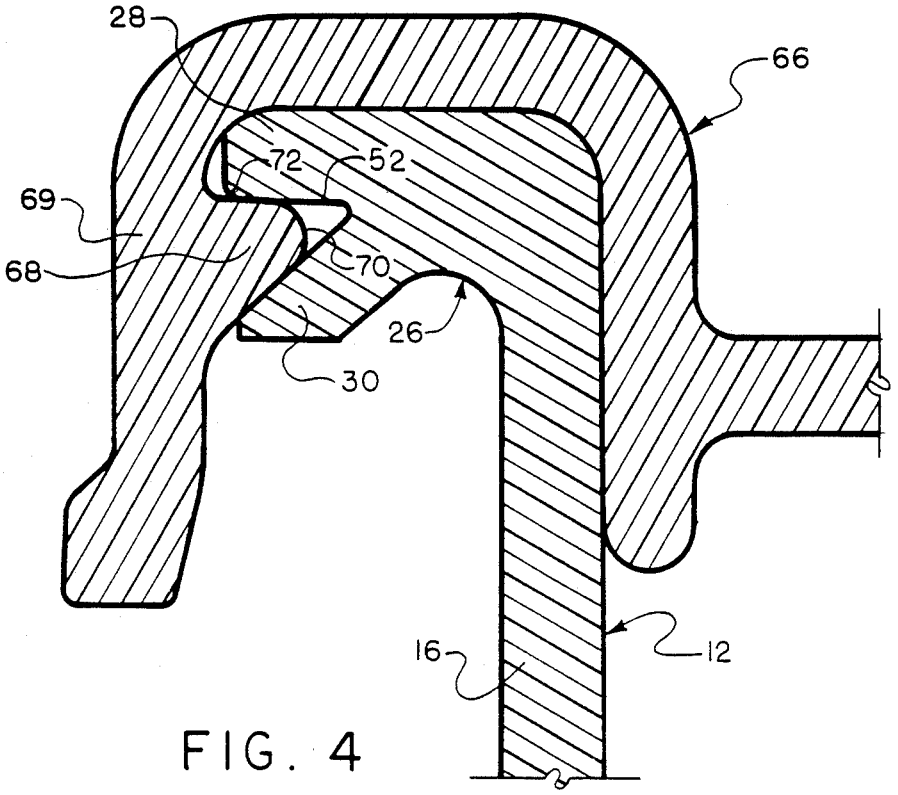
FIG. 4 is a broken away enlarged vertical cross-section of the container of FIG. 1 with an alternate embodiment of a lid made in accordance with the present invention that can be installed on the container without the use of sealing material.

Although as illustrated in FIG. 4, the hook 68 is provided with a rounded end 70, it will be appreciated that the hook 68 may have the same configuration as the pointed or arrowhead-shaped hook 48 of lid 14. However, if a pointed hook-like hook 48 of lid 14 is employed, the material from which the lid is constructed must be elastic enough to allow the pointed hook to cam around the arm 28 of container 12 even through the outer leg 69 has a very short length which requires the outer leg 69 to be bent outwardly at a greater angle (i.e., as compared to a lid with a shorter outer leg such as outer leg 69 of lid 66) as the lid is being installed and removed from the container.

Although the invention has been shown and described with respect to preferred embodiments, it is obvious that equivalent alterations and modifications will occur to others skilled in the art upon reading and understanding this specification. The present invention includes all such equivalent alterations and modifications, and is limited only by the scope of the following claims.

What is claimed:

1. A container assembly comprising a container having a sidewall and open at one end and closed at the other end by a bottom wall, and a lid for closing the open end of said container either with or without the use of sealing material, said sidewall having a lip extending along the open end thereof, said lip comprising an upper horizontally protruding arm and a lower downwardly extending protruding leg spaced beneath said upper arm, said lid including a radially inner vertical leg and a radially outer vertical leg extending substantially parallel to said sidewall of said container and a bridge extending substantially perpendicular to the sidewall and connecting said inner and outer legs, said inner and outer legs and said bridge cooperatively forming a downwardly extending circumferential channel into which said lip of said container is received, said outer leg including a single protruding hook which is capable of engaging said upper arm of said lip at a first position relative to said sidewall so as to facilitate the use of such sealing material between said lid and said container and which is capable of engaging said lower leg of said lip at a second position relative to said sidewall when such sealing material is not utilized between said lid and said container.

2. A container assembly as set forth in claim 1 wherein said protruding lower leg of said lip extends at an angle of about 45° relative to said sidewall of said container.

3. A container assembly as set forth in claim 2 wherein said protruding arm of said lip is located at the extreme top end of said sidewall of said container.

4. A container assembly as set forth in claim 3 wherein said protruding arm of said lip extends along the entire perimeter of said sidewall of said container.

5. A container assembly as set forth in claim 4 wherein said protruding lower leg of said lip extends along the entire perimeter of said sidewall of said container.

* * * * *